United States Patent [19]

Nishikubo

[11] 4,430,008

[45] Feb. 7, 1984

[54] QUARTZ OSCILLATION-TYPE ELECTRONIC TIMEPIECE

[75] Inventor: Yasuhiko Nishikubo, Saitama, Japan

[73] Assignee: Citizen Watch Co., Ltd., Tokyo, Japan

[21] Appl. No.: 281,033

[22] Filed: Jul. 7, 1981

[30] Foreign Application Priority Data

Jul. 28, 1980 [JP] Japan ..... 55-102467
Aug. 12, 1980 [JP] Japan ..... 55-110745

[51] Int. Cl.[3] ..... G04C 3/00
[52] U.S. Cl. ..... 368/202; 368/204
[58] Field of Search ..... 368/203, 204, 219

[56] References Cited

U.S. PATENT DOCUMENTS 4,094,137 6/1978 Morokawa ..... 368/204
4,298,971 11/1981 Morokawa et al. ..... 368/204
4,333,171 6/1982 Nishikubo ..... 368/219

*Primary Examiner*—Bernard Roskoski
*Attorney, Agent, or Firm*—Bernard, Rothwell & Brown

[57] ABSTRACT

A quartz oscillation-type electronic timepiece which consumes less electric power, in which electronic circuits operate on a small constant voltage obtained by a constant-voltage circuit except the portions requiring a relatively high voltage such as display device unit.

2 Claims, 17 Drawing Figures

QUARTZ OSCILLATION-TYPE ELECTRONIC TIMEPIECE

BACKGROUND OF THE INVENTION

1. Field of the Invention

This invention relates to a quartz oscillation-type electronic timepiece, and more specifically to a quartz oscillation-type electronic timepiece employing a quartz oscillator as a time reference source and employing a logic circuit consisting of complementary MOS transistors (hereinafter abbreviated as CMOST's) having means for dividing the frequency of the oscillator to a value suited for the time display means. If mentioned in further detail, the present invention relates to an electronic timepiece equipped with a constant-voltage circuit which is capable of eliminating voltage fluctuation that results from a battery of the type that permits the discharge voltage to vary from 1.8 volts to 1.55 volts, such as silver peroxide battery.

2. Description of the Prior Art

A silver battery has heretofore been used as an energy source for wrist watches. In recent years, a silver peroxide battery was developed as a new silver battery. As compared with the conventional batteries, the silver peroxide battery stores about 50% more energy per unit volume and, hence, features extended serviceable battery life. The silver peroxide battery has an initial voltage of as high as 1.8 to 1.85 volts.

FIG. 1 illustrates discharge characteristics of the silver peroxide battery and of a conventional silver battery, wherein a solid line (a) represents discharge characteristics of the conventional silver battery having a voltage maintained at about 1.55 volts. A broken line (b), on the other hand, represents discharge characteristics of the silver peroxide battery. It will be obvious that the silver peroxide battery exhibits increased voltage variation.

If the silver peroxide battery storing increased amount of energy per unit volume is used for a quartz oscillation-type electronic timepiece which is shown in FIG. 2, a large voltage variation affects the oscillation frequency of the quartz oscillator and deteriorates the precision of the timepiece. Namely, when the battery is renewed, if the pace of the oscillation frequency is corrected by means of a trimmer capacitor or the like, gradual drop in the battery voltage causes the frequency to be shifted by several ppm relative to the initial condition. Therefore, the difference in frequency from the initially set value is accumulated, giving rise to the occurrence of error in the time display.

FIG. 2 is a block diagram of a conventional timepiece which consists of an oscillation unit 1, a frequency-dividing unit 2, a display drive unit 3, and a time display device 4. A silver peroxide battery 7 which is a power supply feeds a constant voltage to the electronic circuit units. With the thus constructed conventional timepiece, however, voltage variation of the silver peroxide battery causes the oscillation frequency to become out of order and decreases the precision of the timepiece.

SUMMARY OF THE INVENTION

A principal object of this invention therefore is to provide an electronic timepiece which is free of the above-mentioned defect inherent in the conventional timepieces.

Another object of this invention is to provide an electronic timepiece which consumes less electric power, in which the electronic circuits operate on a small constant voltage obtained by a constant-voltage circuit, except the portions which require a relatively high voltage such as display drive unit.

A further object of this invention is to provide an electronic timepiece in which the electronic circuits generally have improved temperature characteristics owing to the use of a polycrystalline silicon resistor having a negative temperature coefficient as a reference resistor.

Still further object of this invention is to provide an electronic timepiece which features easy processability, increased temperature stability and more reduced power consumption, by obtaining a secondary voltage using a P-WELL resistance, and by driving at least a block of the complementary MOS integrated circuit by supplying the secondary voltage.

DESCRIPTION OF THE PREFERRED EMBODIMENTS

Embodiments of this invention will be mentioned below in conjunction with the accompanying drawings.

Figure 3:
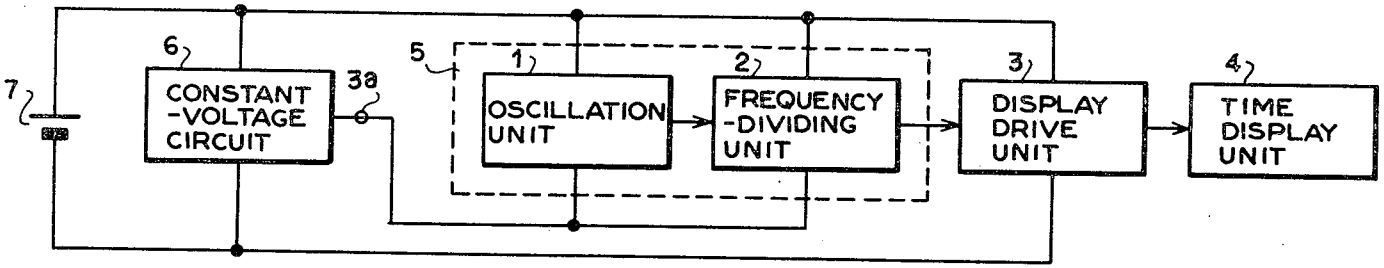
FIG. 3 is a block diagram of a quartz oscillation-type electronic timepiece according to this invention.

FIG. 3 is a block diagram of a quartz oscillation-type electronic timepiece according to an embodiment of this invention. In this embodiment, the voltage of a silver peroxide battery 7 is converted by a constant-voltage circuit 6 into a constant voltage 3*a* of smaller than 1.5 volts. The constant voltage 3*a* is applied to an oscillating/frequency-dividing block 5 which consists of an oscillation unit 1 and a frequency-dividing unit 2. On the other hand, the display drive unit 3 is directly served with the voltage of the battery 7.

Figure 4:
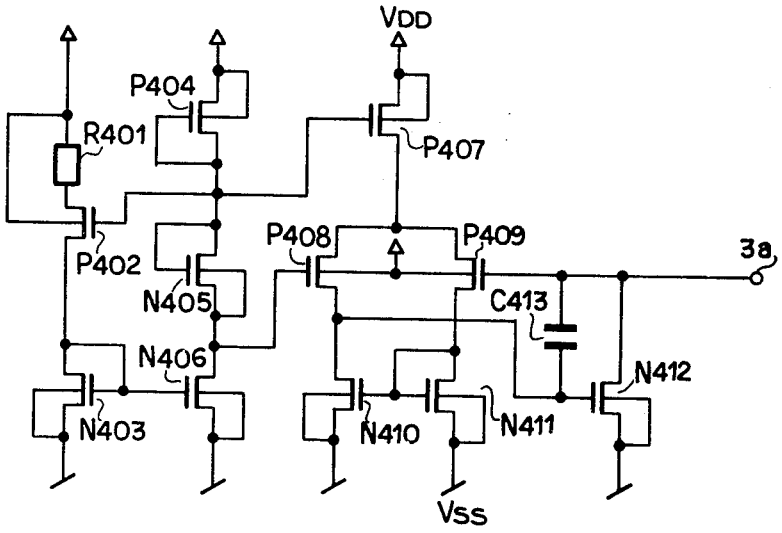
FIG. 4 is a diagram of a constant-voltage circuit according to an embodiment of this invention.
Figure 8:
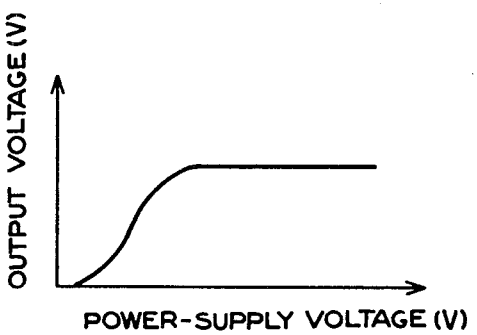
FIG. 8 is a diagram showing a relation between the power-supply voltage and the output voltage of the constant-voltage circuit.

FIG. 4 illustrates the constant-voltage circuit 6 according to an embodiment of this invention, and FIG. 8 shows the output voltage characteristics of the constant-voltage circuit relative to the power-supply voltage. Referring to FIG. 4, a current mirror-type reference voltage unit consists of MOS transistors $P_{402}$, $N_{403}$, $N_{405}$, $N_{406}$ and a reference resistor $R_{401}$. A reference voltage obtained by the reference voltage unit is applied as an input to a differential amplifier consisting of MOS transistors $P_{407}$, $P_{408}$, $P_{409}$, $N_{410}$, $N_{411}$ and $N_{412}$. Owing to the loop inclusive of the differential amplifier which operates on the same voltage as the above reference voltage, a constant output voltage 3*a* is obtained between the drain of the output MOS transistor $N_{412}$ and $V_{DD}$. In order to restrain the variation of load, the output voltage 3*a* also serves as another input to the differential amplifier. In FIG. 4, $C_{413}$ denotes a capacitor for preventing abnormal oscillation in the feedback system and for improving the throughput.

The gain of the current mirror-type reference voltage unit varies depending upon the amplification factors of the MOS transistors; the stability increases with the increase in the gain, resulting, however, in the increase of power consumption. In order to realize a constant-voltage circuit which consumes the electric current of the order of several tens of nanoamperes, therefore, the gain and the reference resistance $R_{401}$ must be determined under considerably severe conditions. Approximately, the gain is given by the following formula, Gain = (amplification factor of $P_{402}$/amplification factor of $P_{404}$) × (amplification factor of $N_{406}$/amplification factor of $N_{403}$)

In the embodiment of FIG. 4, the gain is selected to be 2 to 3, and the value of the reference resistor $R_{401}$ is selected to be 2 to 20 megohms. Further, the resistor $R_{401}$ is realized by a polycrystalline silicon resistor which is obtained by the technique of ion injection. When the gain is to be increased, the value of the resistor $R_{401}$ must be increased correspondingly, or it is not possible to reduce the consumption of power. For example, when the gain is selected to be about 5 to 10, the value of the resistor $R_{401}$ will be 50 to 100 megohms. According to this invention, the gain is increased to decrease the consumption of electric current.

Figure 6:
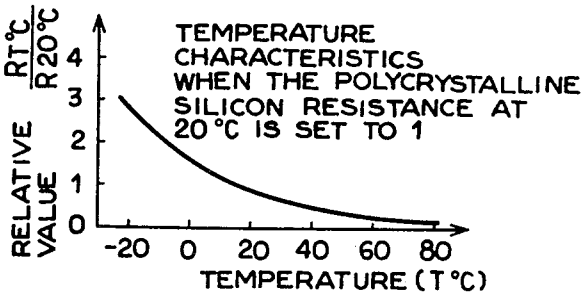
FIG. 6 is a diagram of temperature characteristics of a polycrystalline silicon resistor.
Figure 5:
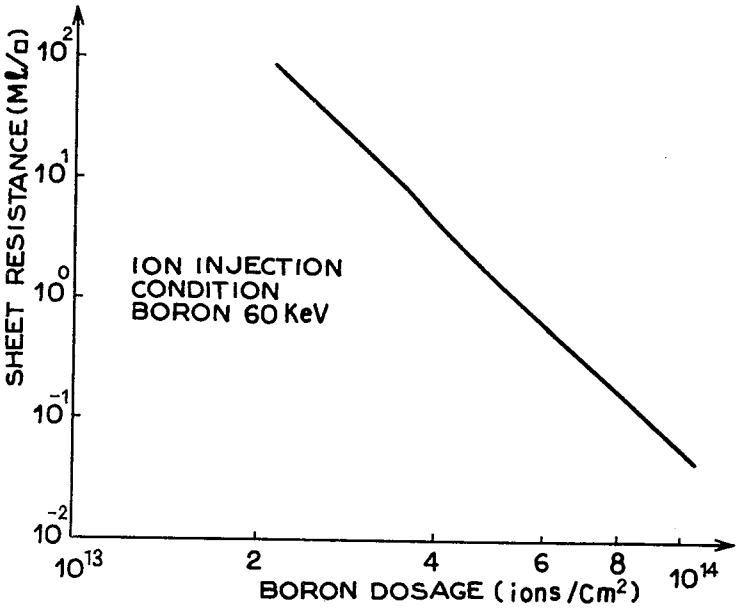
FIG. 5 is a graph showing a relation between the amount of ions injected and the sheet resistance.

FIGS. 5 and 6 are to illustrate the embodiment which employs, as a reference resistor, a polycrystalline silicon resistor prepared by the technique of ion injection. Namely, FIG. 5 is a graph showing a relation between the amount of ions injected and the sheet resistance, and FIG. 6 is a graph showing temperature characteristics when the value of the polycrystalline silicon resistance at 20° C. is 1. As will be obvious from FIG. 5, use of the polycrystalline silicon resistor enables the value to be increased by about 1000 times as compared with the sheet resistance of the conventional diffusion resistor. The sheet resistance of 1 to 30 megohms per square centimeter can be stably obtained by using an ion injecting apparatus. Therefore, it is possible to greatly reduce the area of the resistance region.

Figure 7:
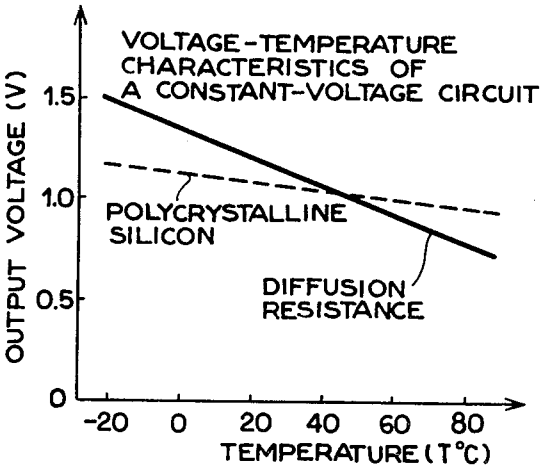
FIG. 7 is a diagram of output voltage characteristics of the constant-voltage circuit relative to the temperature.

In a region where ions are injected in small amounts, furthermore, the polycrystalline silicon resistor exhibits negative temperature characteristics as shown in FIG. 6. The negative temperature characteristics help compensate the temperature characteristics of the constant-voltage circuit. Namely, FIG. 7 is a diagram illustrating the output voltage characteristics of the constant-voltage circuit relative to the temperature, in which a solid line represents output voltage characteristics of the constant-voltage circuit employing the conventional diffusion resistor, and a broken line represents output voltage characteristics when the polycrystalline silicon resistor is used as a reference resistor as contemplated by this invention. Thus, this invention makes it possible to greatly improve the temperature characteristics which were not satisfactory according to the conventional art.

Further, referring to the circuit of FIG. 4, when the power-supply voltage $V_{SS}$ is to be directly applied when the oscillation is being initiated before the oscillation amplitude becomes sufficiently great, the drain and source of the MOS transistor $N_{412}$ should be electrically short-circuited. In other words, another MOS transistor should be connected in parallel with the MOS transistor $N_{412}$ to apply a voltage which renders the gate conductive. Then, if a voltage is applied to render the gate nonconductive by detecting the oscillation after its level has reached a sufficiently great level, the output voltage $V_{SS}$ becomes a constant voltage 3*a*.

FIG. 8 is a diagram showing a relation between the power-supply voltage and the output voltage characteristics of the constant-voltage circuit.

Figure 9:
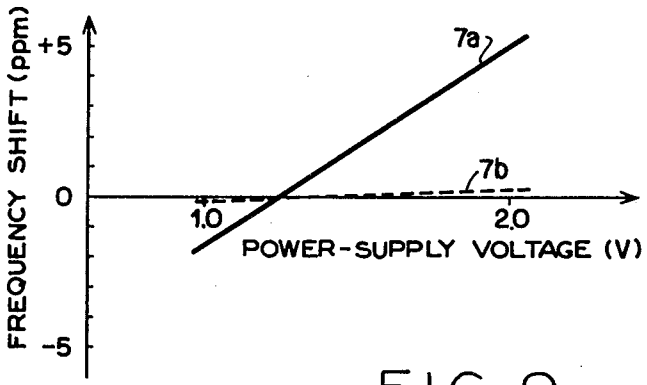
FIG. 9 is a diagram showing a relation between the power-supply voltage and the frequency characteristics according to this invention.

FIG. 9 is a graph showing relations between the power-supply voltage and the frequency characteristics of the circuit of this invention and the conventional circuit, in which a solid line 7*a* represents the data obtained by the conventional circuit and a broken line 7*b* represents the data obtained by using the constant-voltage circuit of this invention. According to the conventional circuit as will be obvious from the above graph, the frequency changes by 6 ppm when the power-supply voltage is changed from 1 volt to 2 volts. According to the device of this invention, on the other hand, the frequency is shifted by only about 0.1 ppm when the power-supply voltage is changed from 2 volts to 1 volt, with the constant voltage being set to 1 volt.

Figure 10:
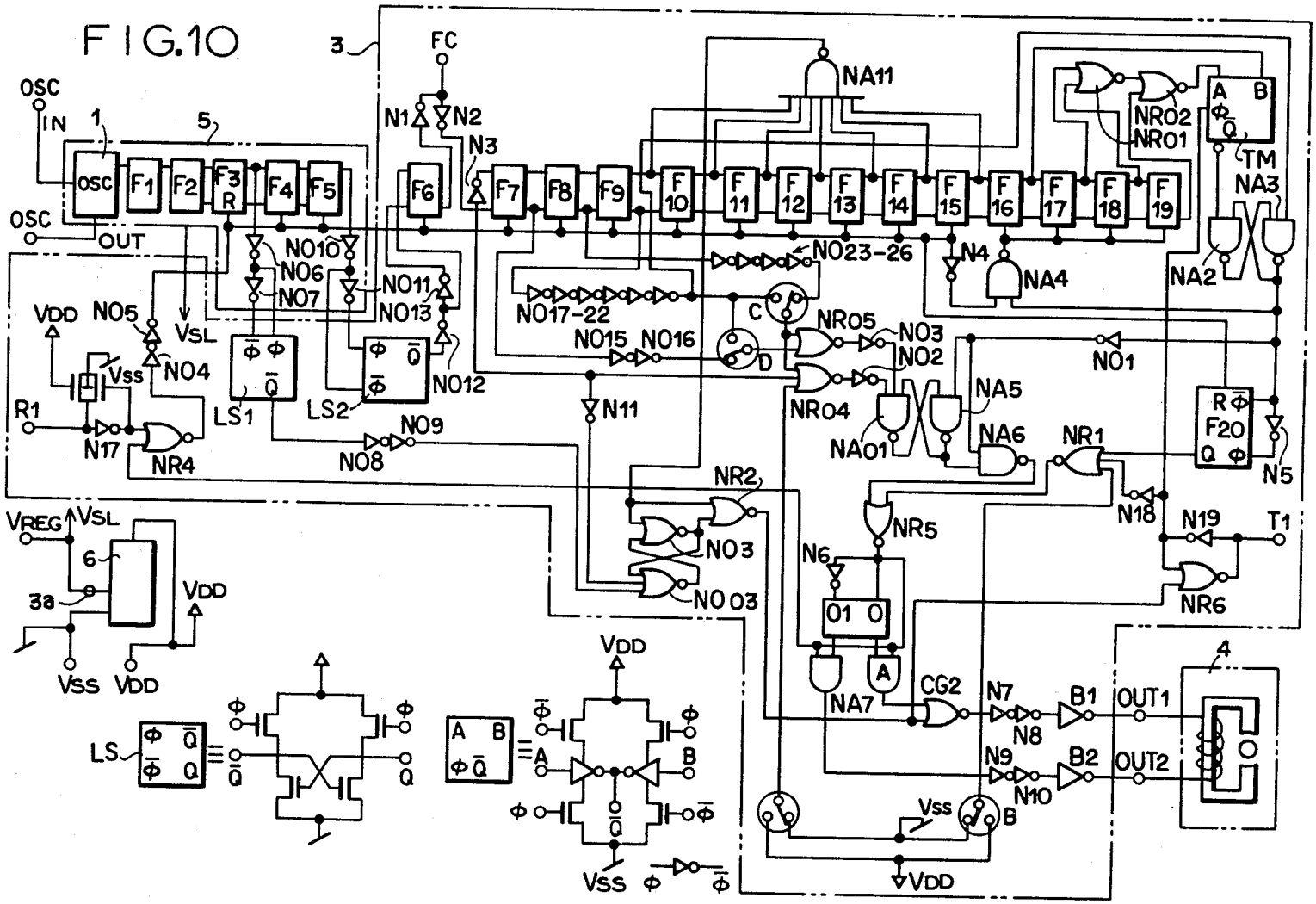
FIG. 10 is a diagram concretely illustrating a circuit of an electronic timepiece according to the embodiment of this invention.

FIG. 10 is a diagram illustrating a whole circuit of an analog-type timepiece according to the embodiment of this invention, in which a region which operates on the secondary voltage is surrounded by a dot-dash line. The signal is converted from a low-voltage level to a high-voltage level (battery voltage) by level-shift circuits $LS_1$ and $LS_2$. This invention can also be applied quite in the same manner to the digital timepieces.

FIGS. 11 to 17 illustrate another embodiment of this invention, in which the first voltage is converted into the second voltage via a P-well resistor 101, and the second voltage is applied to a portion of the electronic integrated circuit.

Figure 11:
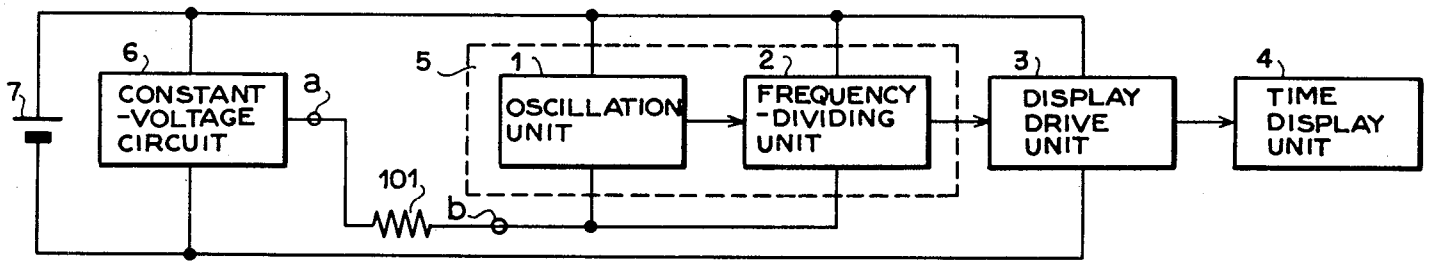
FIG. 11 is a block diagram of a quartz oscillation-type electronic timepiece according to a modified embodiment of this invention.

Referring to FIG. 11, the P-well resistor 101 is inserted between the constant-voltage circuit 6 and the oscillation unit 1, and the constant voltage (a) obtained from the battery 7 through the constant-voltage circuit 6 is applied to the resistor 101. If mentioned in further detail, the resistor is connected in series with the resistor 101 that is formed by the diffusion effected simultaneously with the formation of a low impurity concentration p-type region, i.e., simultaneously with the formation of the p-type WELL region that serves as an n-channel MOST region in the CMOST when the n-type substrate is used, and whereby the primary voltage (a) is converted into the secondary voltage (b). The secondary voltage is applied to the oscillation unit 1 and to the frequency-dividing portion 2, and a battery voltage is directly applied to the display drive unit 3.

Figure 12:
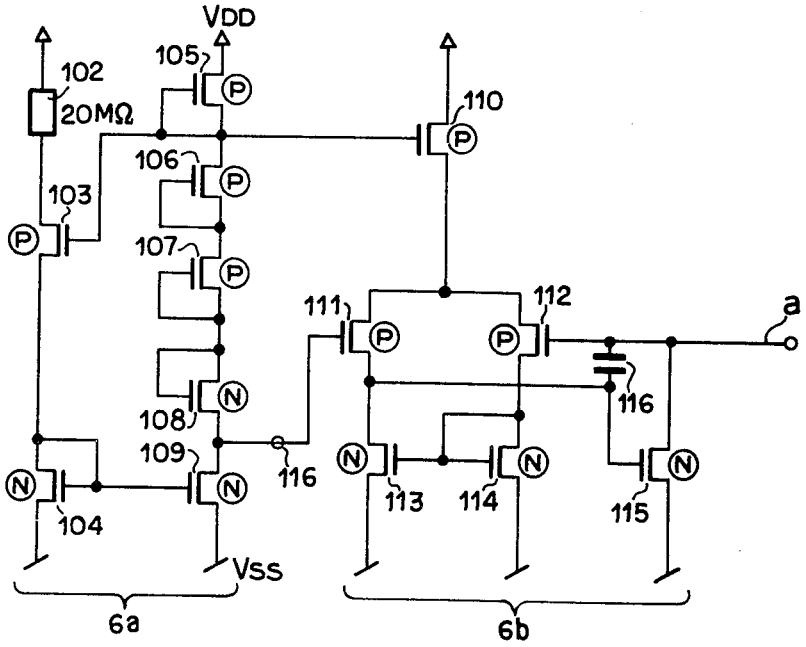
FIG. 12 is a diagram of a constant-voltage circuit employed for the timepiece of FIG. 11.

FIG. 12 is a diagram of the constant-voltage circuit according to a further embodiment of this invention, in which a reference voltage 116 is determined by the MOST, reference resistor 102 and the gain. A shift width in the absolute value, however, is greatly affected by the p-channel MOST's 106, 107 and the n-channel MOST 108. Namely, the reference voltage 116 is about 0.4 volt when the MOST's 106, 107 and 108 are all short-circuited. The reference voltage, however, becomes about 1.4 volts when an offset of a threshold voltage corresponding to three MOS transistors is added in the circuit of this embodiment. Thus, the reference voltage can be shifted toward a higher value by connecting the MOS transistors in series between the MOS transistors 109 and 105 which determine the gain. According to this invention, a plurality of MOS transistors are used to obtain an offset voltage, since the primary voltage must be set to a value greater than 1 volt. Therefore, many of the MOS transistors employed are of the p-channel type. It is because the n-channel MOS transistor exhibits a stable threshold voltage when the ions are injected. The threshold voltage of the p-channel MOS transistor, however, is affected by the variance in concentration of the substrate, and is not stabilized unless increased number of manufacturing steps are added.

Namely, according to the circuit of FIG. 12 of this invention, when the threshold voltage of the p-channel is increased and the minimum operation voltage of the circuit is increased, the primary voltage (a) is increased due to the offset of the MOS transistors. Therefore, the secondary voltage is necessarily greater than a minimum operation voltage to absorb unstable factors in the concentration of silicon substrate and in the process. According to this invention, furthermore, variance in the threshold voltage of the n-channel MOS transistors is absorbed while the secondary voltage is being generated as will be mentioned later. More desirably, therefore, variance in the threshold voltage of the p-channel MOS transistors should be absorbed while the primary voltage is being generated.

Figure 13:
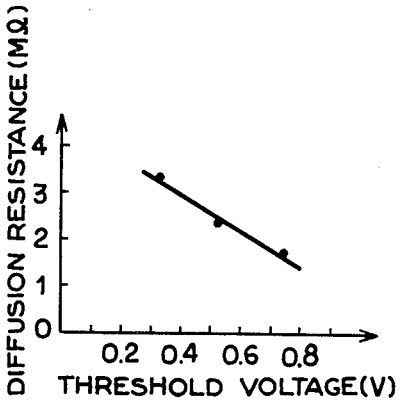
FIG. 13 is a diagram illustrating a relation between the threshold voltage and the diffusion resistance.

FIG. 13 is a diagram for illustrating the secondary voltage. Here, a threshold voltage of CMOS·IC for electronic timepieces has been set to be about 0.4 to 0.6 volt. The concentration of impurities in the surface of the p-type well region is $1\times10^{16}/cm^3$, and the sheet resistance is 5 to 6 kiloohms per square centimeter. FIG. 13 illustrates a relation between the threshold voltage V and the diffusion resistance R which is formed through a step that is carried out simultaneously with the diffusion of impurities in the p-type well region. The mask pattern for forming the resistor has a size measuring 10 microns$\times$5000 microns and a diffusion depth of 7 microns. As will be obvious from FIG. 13, the resistance R increases with the decrease in the threshold voltage, which is very desirable as compared with when a resistor which does not change is connected. It is because, when the threshold voltage of the n-channel MOS transistor is small, i.e., when the impedance of the n-channel MOS transistor is small, the voltage drops greatly across a large resistance to restrain the electric current which flows into the MOS transistors. Conversely, when the threshold voltage is great, i.e., when the impedance is great, the voltage drop is reduced across a small resistance so as not to greatly restrain the electric current which flows into the MOS transistors.

Figure 14:
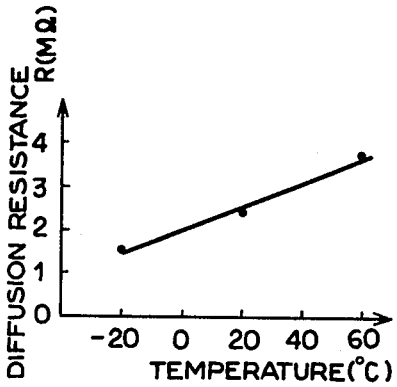
FIG. 14 is a graph showing a relation between the temperature and the diffusion resistance.
Figure 15:
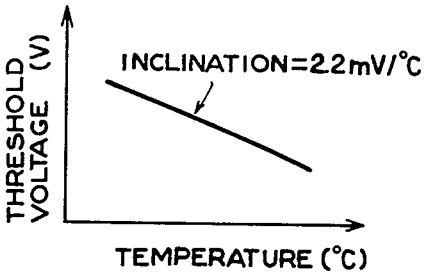
FIG. 15 is a diagram showing a relation between the temperature and the threshold voltage.

The greatest feature of this embodiment which employs the secondary voltage is its excellently stabilized temperature characteristics. FIG. 14 shows the practically measured data of the temperature (°C.) and the diffusion resistance R (megohms), and FIG. 15 shows the practically measured data of the temperature (°C.) and the threshold voltage of the MOS transistor. As will be obvious from FIG. 14, the diffusion resistance R increases with the increase in temperature; the flow of current is restricted and the voltage drop increases across the diffusion resistance R. When the temperature is decreased, on the other hand, the resistance is decreased, the current is increased, and the voltage drop decreases across the diffusion resistance R.

Figure 16:
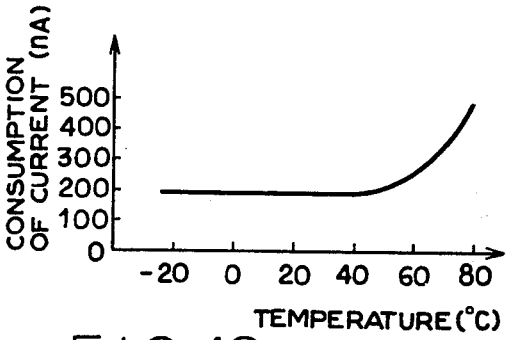
FIG. 16 is a graph showing a relation between the temperature and the electric current consumed.

Conversely, as the temperature increases, the threshold voltage of the MOS transistor decreases, the current increases, and the impedance of the CMOS transistor decreases. As the temperature decreases, on the other hand, the threshold voltage increases, the current decreases, and the impedance of the CMOS transistor increases. Therefore, the impedance as a whole is stabilized relative to the temperature, and the consumption of electric current and a minimum operation voltage of the circuit become constant. FIG. 16 shows the practically measured data of the temperature (°C.) and the consumption of electric current (nA).

Figure 1:
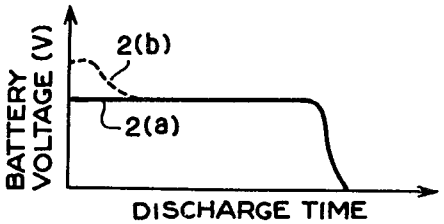
FIG. 1 is a graph showing discharge characteristics of a conventional silver battery and a silver peroxide battery.
Figure 2:
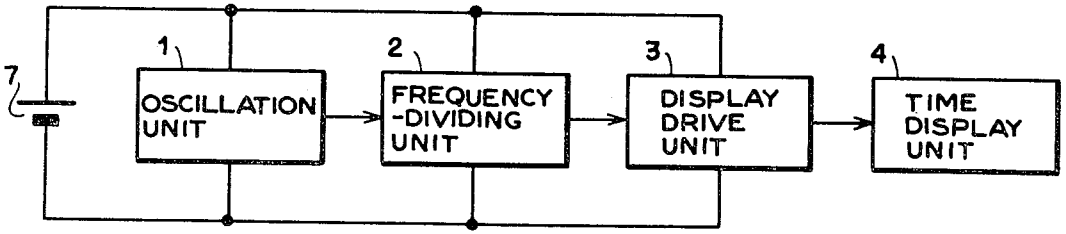
FIG. 2 PRIOR ART
FIG. 2 is a block diagram of a conventional quartz oscillation-type electronic timepiece.
Figure 17:
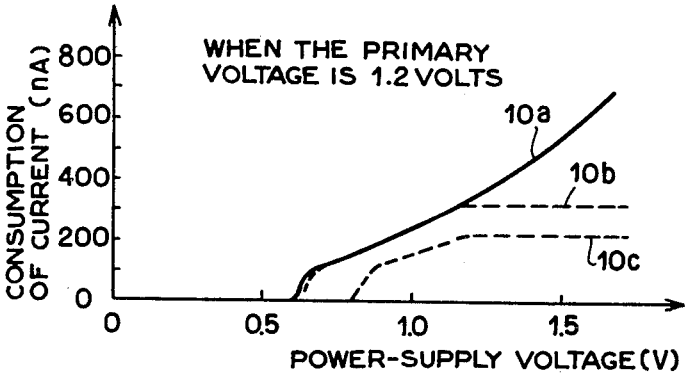
FIG. 17 is a graph showing a relation between the power-supply voltage and the electric current consumed by the circuit of this invention.

Further, FIG. 17 shows voltage vs. current characteristics which are measured using a practical circuit. In FIG. 17, characteristics of the conventional circuit of FIG. 1 are represented by a curve 10*a*, characteristics of a circuit employing the constant-voltage circuit only are represented by a curve 10*b*, and characteristics of the circuit made up of the constant-voltage circuit and the P-well resistor according to the embodiment of this invention are represented by a curve 10*c*. According to this invention as mentioned above, the voltage which is stabilized makes it possible to prevent the timepiece performance from being deteriorated by the voltage fluctuation. Furthermore, the P-well resistance makes it possible to facilitate the processability and to stabilize the temperature characteristics. Moreover, the above-mentioned effects help reduce the consumption of electric power.

According to this invention as explained above, a constant voltage is set to be smaller than an ordinary voltage of the silver peroxide battery, such that the oscillation unit operates on the constant voltage at all times even when the battery voltage is decreased due to the discharge characteristics.

Furthermore, by using the polycrystalline silicon resistor having a negative temperature coefficient as a reference resistance, it is allowed to obtain an electronic timepiece having generally improved temperature characteristics.

What is claimed is:

1. A quartz oscillation-type electronic timepiece comprising:

(a) a time reference source consisting of a quartz oscillator or the like;

(b) frequency-dividing means which receives time reference signals from said time reference source;

(c) a display drive unit which receives time unit signals from said frequency-dividing means;

(d) a battery which supplies the energy to each of the above-mentioned portions; and (e) a constant-voltage circuit which is connected between the terminals of said battery to make the voltage of said battery constant, and which consists of a current mirror-type reference voltage generator and a differential amplifier; wherein (f) a current mirror type reference voltage generator is characterized in that it is composed of a pair of poles, a reference resistor is connected in series to an MOS transistor in the first pole, an output of the first pole becomes an input of the second pole, an output of the second pole is an input of the first pole and fed back with each other, plurality of MOS transistors are inserted between the MOS transistor connected to the output of the second pole and the drain of MOS transistor connected to the input of second pole, namely the reference voltage output terminal end, thereby the reference voltage higher than a voltage obtained before insertion of said MOS transistors as much as the sum of threshold voltages of said MOS transistors inserted can be generated;

(g) said reference resistor of said current mirror type reference voltage generating circuit is a polysilicon resistor having a negative temperature coefficient which can be obtained by adding the process of implanting impurity ion in such a concentration sufficiently lower than that of source, drain diffusion to the standard silicon gate CMOS process and its resistance value is 1 M-ohms or more;

(h) said differential amplifier of a constant voltage circuit is characterized in that an output of second pole of the current mirror type reference voltage generator is provided as the gate input of the MOS transistor which operates as a constant voltage source thereof, a reference voltage output of the current type reference voltage generator becomes the first input of the differential amplifier, an output of differential amplifier is supplied to load electronic circuits through an inverter, a potential to be supplied to a load electronic circuit is fed back as the second input of the differential amplifier, and as a whole, an output of a constant voltage circuit is caused to have a low impedance and thereby the reference voltage is not changed by fluctuation of load electronic circuit;

(i) said time reference source through up to a time display device are made up of an integrated circuit consisting of complementary MOS transistors, and at least a portion of said integrated circuit is operated by a constant voltage produced by said constant-voltage circuit.

2. A quartz oscillation-type electronic timepiece as set forth in claim 1, wherein in order to convert a primary voltage produced by said constant-voltage circuit into a secondary voltage, a resistor is further connected to said constant-voltage circuit, said resistor being formed by the diffusion simultaneously with the formation of a p-well region which is a low impurity concentration p-type region that serves as an n-channel MOS transistor region in the complementary MOS transistors formed on an n-type substrate.

* * * * *